US008814625B1

(12) United States Patent
Long

(10) Patent No.: US 8,814,625 B1
(45) Date of Patent: Aug. 26, 2014

(54) TACTILE, VISUAL AND AURAL TOY FOR ENTERTAINMENT AND LEARNING

(71) Applicant: Pamela Long, Phoenixville, PA (US)

(72) Inventor: Pamela Long, Phoenixville, PA (US)

( * ) Notice: Subject to any disclaimer, the term of this patent is extended or adjusted under 35 U.S.C. 154(b) by 60 days.

(21) Appl. No.: 13/737,598

(22) Filed: Jan. 9, 2013

(51) Int. Cl.
*A63H 3/28* (2006.01)
*A63H 33/00* (2006.01)
*A63F 9/06* (2006.01)

(52) U.S. Cl.
CPC ..... *A63H 33/00* (2013.01)
USPC ..... 446/175; 446/227; 446/484

(58) Field of Classification Search
USPC ..... 446/71, 175, 219, 227, 484; 434/159, 434/258, 259
See application file for complete search history.

(56) References Cited

U.S. PATENT DOCUMENTS

| | | | | |
|---|---|---|---|---|
| 2,416,959 | A | 3/1947 | Segal | |
| 2,963,796 | A | 2/1959 | Zalkind | |
| 2,911,740 | A | 11/1959 | Miller | |
| 3,646,592 | A | 2/1972 | Bosley et al. | 35/9 D |
| 3,760,511 | A | 9/1973 | Matsumoto | 35/22 |
| 4,008,526 | A | 2/1977 | Swett et al. | 35/22 |
| 4,149,717 | A | 4/1979 | Seijiro | 273/1 |
| 4,176,470 | A | 12/1979 | Fosner et al. | 35/22 |
| 4,195,421 | A | 4/1980 | Tucker et al. | 35/22 |
| 4,323,238 | A | 4/1982 | Jernstrom et al. | 273/1 |
| 4,385,762 | A | 5/1983 | Schwartz | 273/1 GC |
| 4,609,356 | A | 9/1986 | Gilden et al. | 434/259 |
| 4,846,692 | A | 7/1989 | Delcambre | 434/159 |
| 4,968,255 | A | 11/1990 | Lee et al. | 434/159 |
| 5,190,287 | A | 3/1993 | Ishiyama | 273/156 |
| 5,454,745 | A | 10/1995 | Spielberger | 446/71 |
| 5,478,268 | A | 12/1995 | Au | 446/227 |
| 6,062,937 | A * | 5/2000 | Kikuchi | 446/91 |
| 6,231,345 | B1 | 5/2001 | Yamazaki et al. | 434/259 |
| 6,755,655 | B2 | 6/2004 | Marcus et al. | 434/156 |
| 6,755,713 | B1 | 6/2004 | Weber et al. | 466/143 |
| D531,229 | S | 10/2006 | Vanbenden | D21/386 |
| 7,137,819 | B2 | 11/2006 | Bagues | 434/188 |
| 7,238,026 | B2 * | 7/2007 | Brown et al. | 434/258 |
| 7,607,962 | B2 * | 10/2009 | Hardin | 446/484 |
| 7,857,624 | B2 | 12/2010 | Davis et al. | 434/128 |
| D660,664 | S | 5/2012 | Hsu | D8/25 |
| 2002/0061701 | A1 | 5/2002 | Chan | 446/175 |
| 2003/0038423 | A1 | 2/2003 | Turner et al. | 273/157 |
| 2003/0148700 | A1 | 8/2003 | Arlinsky et al. | 446/91 |

* cited by examiner

*Primary Examiner* — Kien Nguyen
(74) *Attorney, Agent, or Firm* — Petock & Petock, LLC

(57) ABSTRACT

A tactile, visual and aural toy for entertainment and learning includes a base with receptacles for receiving a corresponding three dimensional shapes. Each shape is provided with lights and sounds which are energized when motion of the shape is detected. The placing of the first shape in its corresponding receptacle determines which musical rendition will be played by the base when all of the receptacles have been filled by their correct corresponding three dimensional shape. The three dimensional shapes may be coordinated with sections of the base related to a particular receptacle by color or animal. The base also provides a light show visible through a translucent dome on the base. The particular light show which occurs is determined in the same manner as the determination of which musical rendition is played.

13 Claims, 5 Drawing Sheets

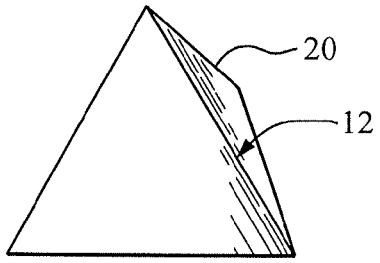
FIG. 2a
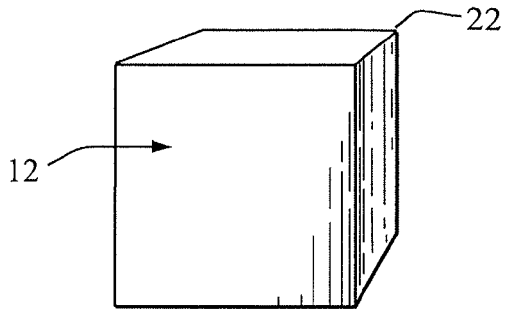
FIG. 2b
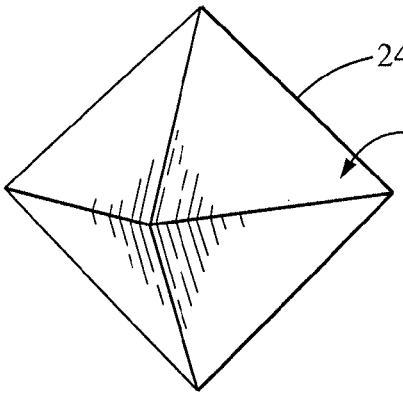
FIG. 2c
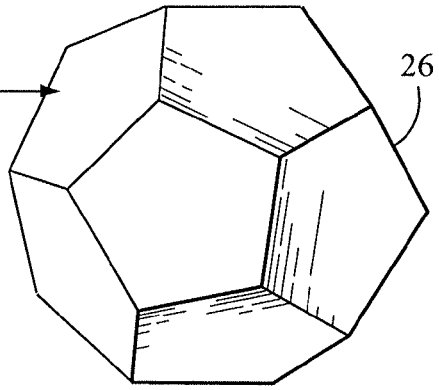
FIG. 2d
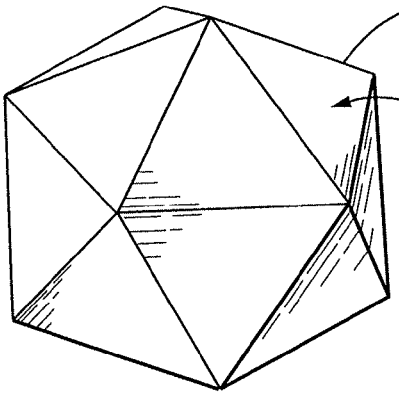
FIG. 2e
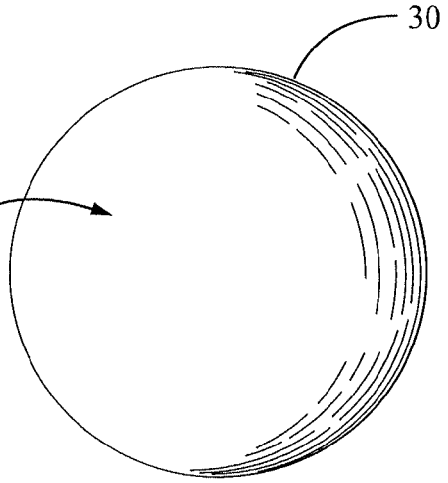
FIG. 2f
FIG. 2

FIG. 4
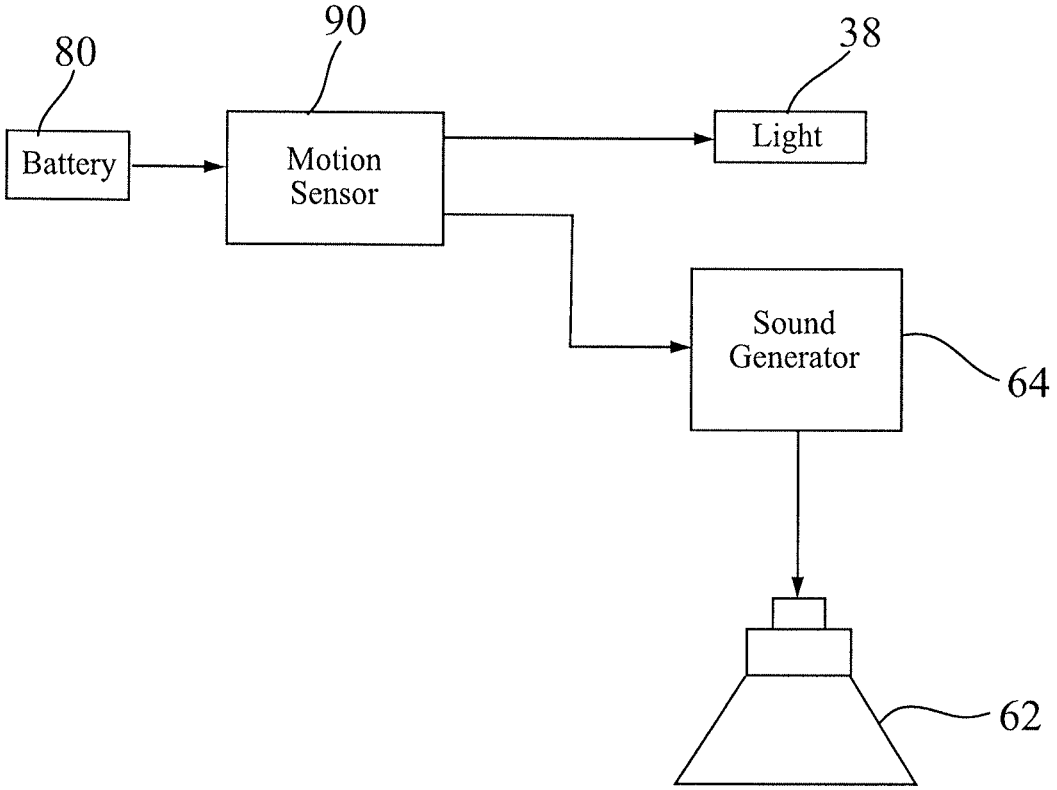
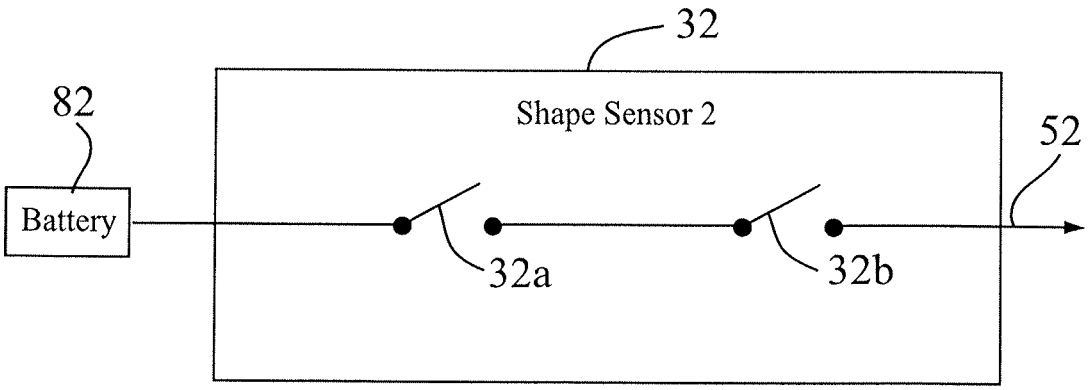
FIG. 5a

TACTILE, VISUAL AND AURAL TOY FOR ENTERTAINMENT AND LEARNING

FIELD OF THE INVENTION

The present invention relates to a tactile, visual and aural toy for entertainment and learning.

More particularly, the present invention relates to a tactile, visual and aural toy for entertainment and learning which includes a plurality of shapes having both visual and sound effects when moved and a base which plays a musical rendition or song when all of the shapes have been placed in their corresponding receptacles, which song played is determined by which shape was first placed in its corresponding receptacle.

BACKGROUND OF THE INVENTION

There are many new toys generated each year for children to play with. There is a need for toys which not only provide entertainment, but also provide learning experiences and provide a stimulus to the child.

SUMMARY OF THE INVENTION

The present invention provides a toy for entertainment and learning.

An advantage of the present invention is that it provides visual and audible stimulation to the child from the moment that the child moves a shape by picking it up or otherwise moving it.

Another advantage of the present invention is that it provides a means of teaching young children about three dimensional shapes.

Another advantage of the present invention is that it provides a means of playing a different musical rendition or song depending upon which shape is first placed in its corresponding receptacle in a base when all of the shapes have been placed in their corresponding receptacles.

Briefly and basically, the present invention comprises a toy which includes a plurality of three dimensional shapes and a base. In a presently preferred embodiment, six three dimensional shapes may be utilized, but it is understood that more or less shapes may be utilized in practicing the present invention. Each of the plurality of shapes is provided with a motion sensor for detecting movement of the shape and in response to detecting movement, activating a light display and a sound program. A light display generates a light activation or a series of light activations in a sequence correlated to the specific shape and the sound program generates a sound or sounds correlated to the specific shape.

The base has a plurality of receptacles for receiving the plurality of shapes. Each of the receptacles is formed to receive only one of the plurality of shapes and each of the receptacles is provided with a shape sensor for generating a predetermined signal in response to sensing when a corresponding shape has been inserted in the receptacle. The base further includes a control means for receiving the shape sensing signal from each of the plurality of receptacles in the base and activating the playing of a predetermined musical rendition correlated to which shape was first inserted in a receptacle in the base when the control means determines that a correctly correlated shape has been placed into each receptacle of the base.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

FIG. 2 is composed of six sub figures FIG. 2*a*, FIG. 2*b*, FIG. 2*c*, FIG. 2*d*, FIG. 2*e* and FIG. 2*f* each of which is a view in perspective of one of six shapes which are presently preferred shapes utilized in practicing the present invention but various other shapes may be utilized.

FIG. 4 is a schematic block diagram of circuitry which may be utilized in the shapes of a toy in accordance with the present invention.

FIG. 5*a* is a schematic diagram, at least partially in block diagram form illustrating two micro switches in series used as a shape sensor such as Shape Sensor 2 of FIG. 5.

DETAILED DESCRIPTION OF THE PREFERRED EMBODIMENTS

Figure 1:
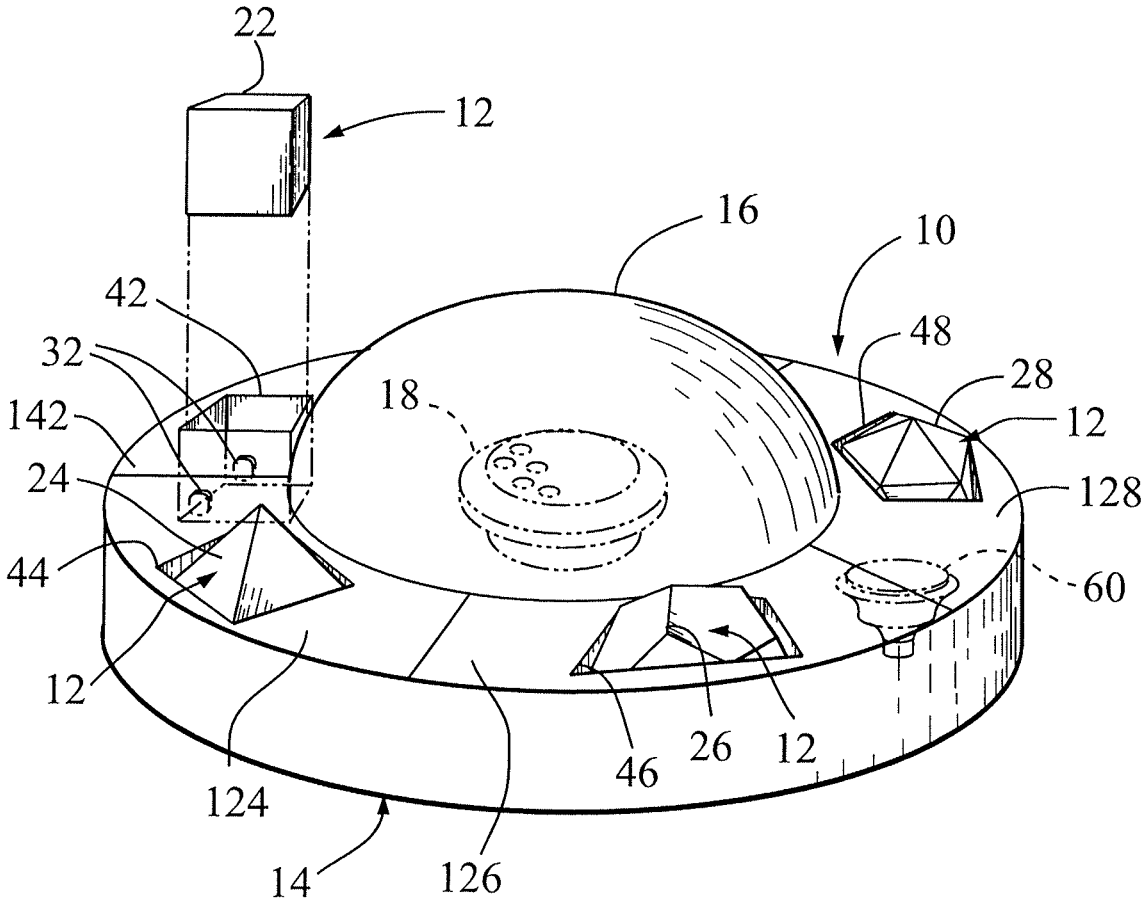
FIG. 1 is a view in perspective of a tactile, visual and aural toy for entertainment and learning in accordance with the present invention.

Referring now to the drawings in detail, wherein like numerals indicate like elements, there is shown in FIG. 1 a tactile, visual and aural toy 10 which may be utilized for entertainment and learning. This is particularly of value to young children, such as toddlers, but may be utilized by anyone including adults. Toy 10 is comprised of a plurality of three dimensional shapes which may be referred to collectively by numeral 12 and these may be comprised of a plurality of shapes such as the six three dimensional shapes illustrated in FIG. 2 and identified as tetrahedron 20 illustrated in sub FIG. 2*a*, cube 22 illustrated in sub FIG. 2*b*, octahedron 24 illustrated in sub FIG. 2*c*, dodecahedron 26 illustrated in sub FIG. 2*d*, icosahedron 28 illustrated in sub FIG. 2*e* and sphere 30 illustrated in sub FIG. 2*f*. In a presently preferred embodiment, six such shapes may be utilized and the specific ones chosen may be utilized. However, it is understood that more or less than six shapes may be utilized in practicing the present invention, and other three dimensional shapes may be utilized.

Figure 5:
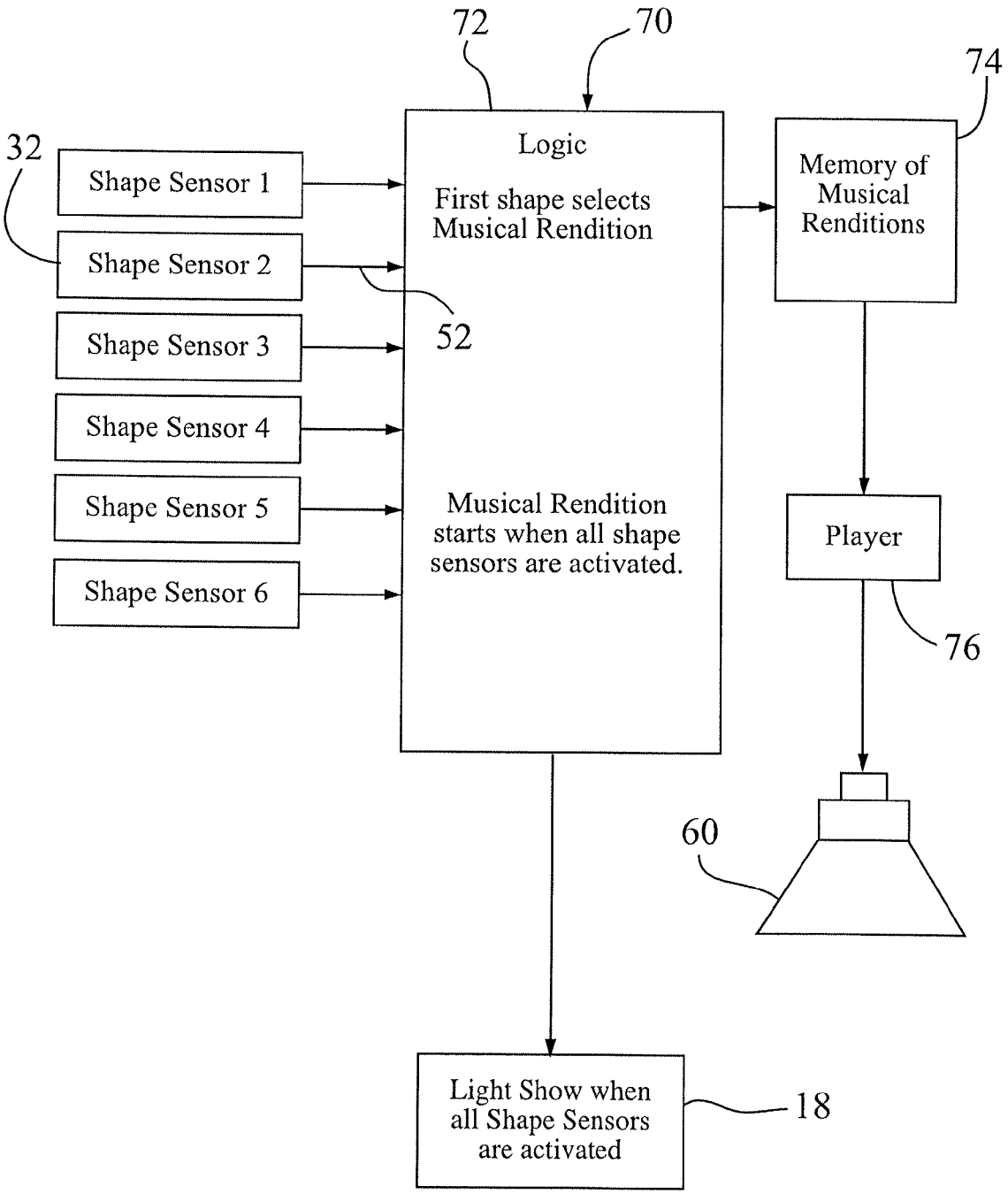
FIG. 5 is a schematic block diagram of circuitry which may be utilized in the base of a toy in accordance with the present invention.

Toy 10 further comprises a base 40 which is provided with a plurality of receptacles 42, 44, 46, 48 shown in FIG. 1 for receiving the plurality of shapes. The receptacles for tetrahedron 20 and sphere 30 are not visible as they are blocked by dome 16. Each receptacle is formed to receive only one of the plurality of shapes and each of the receptacles is provided with a shape sensor, such as shape sensors 32 in the form of micro switches in receptacle 42 for cube 22 as best illustrated in FIG. 1. In a similar manner, all of the receptacles are provided with sensors which sense when the corresponding three dimensional shape is placed in its corresponding receptacle. For example receptacle 44 would have sensors positioned to detect when three dimensional shape in the form of octrahedron 24 is placed in the receptacle. The sensors will not be activated when an incorrect shape is placed into the receptacle. This may and typically will require that there be more than one sensor, such as a micro switch, making up the sensor for a particular shape within a particular receptacle. In other words, if a single sensing element such as a single micro switch is utilized, it may be possible to depress that micro switch by an incorrect shape. But by placing multiple sensors in each receptacle, and requiring that all of the sensors be activated or turned on by the shape being placed within the receptacle, an output signal from the sensor as a whole will only occur when the correct or corresponding shape is placed in the correct or corresponding receptacle. For example, referring to FIG. 5*a*, if Shape Sensor 2 of FIG. 5 is the shape sensor 32 for cube 22, a presently preferred embodiment may utilize two micro switches 32*a* and 32*b* connected in series as illustrated in FIG. 5*a*. Only when both micro switches 32*a* and 32*b* are closed by the presence of cube 22 will a signal output be supplied online 52 in the form of voltage from battery 82. This aspect will be described more fully hereinafter.

Base 14 may be provided with a central dome 16 which may include one or more lights such as LED light 18. As will be explained more fully hereinafter, LED light 18 may be utilized to create a light show by energizing and de-energizing LED light 18 in a predetermined sequence determined by which shape is detected to have been first placed in a corresponding receptacle. Base 14 is preferably circular in shape as illustrated in FIG. 1. However, it is understood that various other shapes may be utilized for base 14. Base 14 may be provided with a hemispherical translucent dome 16. However, the raised portion in the center of base 14 may be other shapes. Base 14 may be provided with one or more speakers 60 as illustrated in FIG. 1. Speaker 60 may be utilized to play a particular musical rendition or to make other sounds depending upon which shape is first placed into its corresponding receptacle after all of the receptacles have been filled by their corresponding shapes. This is controlled by a control means 70 which will be described in more detail with respect to FIGS. 4, 5 and 5*a*.

The plurality of three dimensional shapes 12, such as three dimensional shapes 20, 22, 24, 26, 28 and 30 may be provided with additional means for stimulating the child or other player of the toy of the present invention by generating a light display and a sound program when movement of the three dimensional shape occurs. For example, the picking up of block 22 or the movement of the block 22 by sliding it along a play table or other surface may be used to initiate by means of a motion detector a light display and a sound program. The light display generates a light activation or a series of light activations in a sequence correlated to the specific shape and the sound program generates a sound or sounds correlated with the specific shape. For example, in FIG. 3 there is illustrated a three dimensional shape in the form of a cube 22 which is provided with a battery 80, a motion sensor 90, a speaker 62 and a light in the form of light emitting diode light or LED light 38.

Battery 80 may be any suitable battery, preferably a long life battery or even a battery pack which includes a solar cell rechargeable battery. Alternatively, access may be made, such as by a removable battery cover plate, into the three dimensional shape, such as cube 22, to replace the battery. Motion sensor 90 detects motion and may be utilized in cube 22 and other three dimensional shapes 12 as illustrated in FIG. 4. Speaker 62 is also provided for making the sound program audible. The sound program may be any suitable sound or noise which corresponds to the particular three dimensional shape which is being utilized.

The shapes and the base may be correlated in several other ways to enhance learning and association of different categories of items. For example, the shapes 20, 22, 24, 26, 28 and 30 or any other shapes which are utilized may be color coded such that shape 22 is a green cube and the quasi wedge shaped section 142 surrounding receptacle 42 on base 14 is colored green. In a similar manner, tetrahedron 20 may colored orange, octahedron 24 may be colored yellow and the quasi wedge shaped section 124 of base 14 provided with a similar yellow color. Dodecahedron 26 may be colored red and the corresponding quasi wedge shape section 126 may be colored red. Similarly, icosahedron 28 and peripheral section 128 of the base may be colored blue. Sphere 30 and its corresponding wedge shaped section on the base could be colored purple. These are only examples and other color coordinations may be selected as desired.

In a similar manner, the three dimensional shapes and their corresponding section on the base may be provided with pictures, designs or drawings of animals or other natural things. For example, tetrahedron 20 and its corresponding base element could be associated with a gecko. Cube 22 and its corresponding quasi wedge shaped section 142 on the base could be associated with a turtle. The octahedron 24 and its associated section 124 on the base 114 could be associated with a bird. The icosahedrons 28 and its associated section on the base could be associated with a dolphin. The dodecahedron 26 and its associated section 126 could be associated with a dragon and sphere 30 and its associated quasi wedge shaped section on the base could be associated with a whale. Again, these are only examples and various other things occurring naturally in nature may be associated with the base sections and their corresponding three dimensional shapes.

Figure 3:
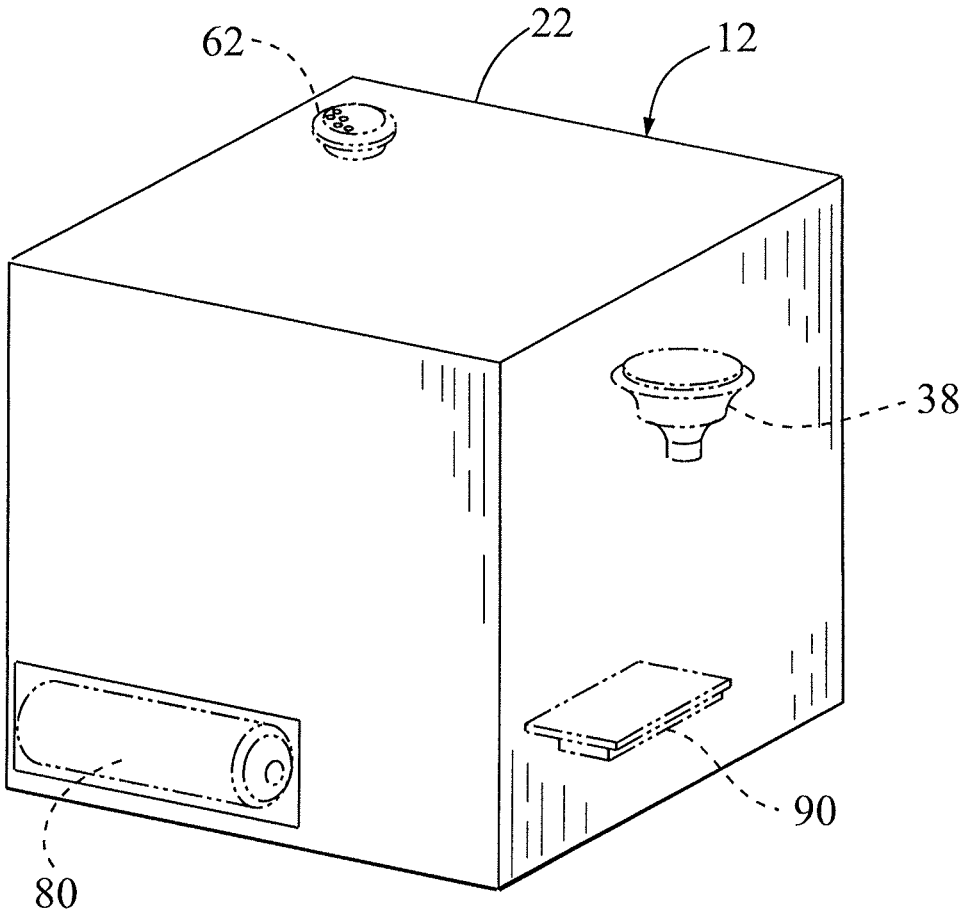
FIG. 3 is a view in perspective of an enlarged shape showing in dotted lines some of the structure contained therein in accordance with the present invention.

As discussed with respect to FIG. 3, a schematic diagram is illustrated in FIG. 4 for the three dimensional shapes 12 such as tetrahedron 20, cube 22, octahedron 24, dodecahedron 26, icosahedrons 28 and sphere 30. Each shape 12 would be provided with a motion sensor 90 which upon detection of motion connects battery power from battery 80 to light or LED light 38 and a sound generator 64 which may have sounds stored on a memory or other means of generating particular sounds which are then fed to speaker 62.

Referring now to FIG. 5, there is shown a control means for base 14 for receiving the shape sensing signals from each of the plurality of receptacles in the base and activating the playing of a predetermined musical rendition correlated to which shape was first inserted in its corresponding receptacle in the base when the control means determines that a correctly correlated shape has been placed into each receptacle of base 14.

As discussed above with respect to FIGS. 1 and 5*a*, a plurality of shape sensors are provided. Each shape sensor 1 through 6 is provided with at least one sensor and preferably with multiple sensors so that only one three dimensional shape inserted into a receptacle will result in an output signal from the shape sensor. Accordingly, preferably each shape sensor 1 through 6 contains multiple sensors. These multiple sensors may be micro switches, photo cell detection units or any other suitable sensor which may be utilized within the base to detect that a closely fitting shape has been inserted into the receptacle. These may be a series of switches which since they are connected in series produce an output only when all of the sensors for a particular receptacle are activated or closed as illustrated with respect to FIG. 5*a*.

The control means 70 further includes logic circuitry which detects which shape sensor was first activated by the insertion of a three dimensional shape. This is easily detected and may be stored in a memory. The playing of the musical rendition will not occur immediately upon the insertion of the first shape into the first receptacle, but the placing of a selected shape into its correct receptacle determines which musical rendition will eventually be played. The playing of the musical rendition does not occur until all of the three dimensional shapes are placed correctly in their corresponding receptacles. In a presently preferred embodiment, this would mean that all six three dimensional shapes must be placed into their corresponding receptacle. When this occurs, the musical rendition selected by which one of the three dimensional shapes was first placed into the base is selected from the memory of musical renditions 74 and played on player 76 and heard audibly by means of speaker 60. Musical renditions may preferably be songs, but any other musical rendition may be utilized in practicing the present invention. The musical rendition may even include a musically accompanied story or the like.

The completion of the proper placement of all of the three dimensional shapes into all of the corresponding receptacles in base 14 also results in generation of a light show by means of one or more LED lights 18 contained within the dome 16 of base 14.

The present invention may be embodied in other specific forms without departing from the spirit or essential attributes thereof and, accordingly, reference should be made to the appended claims, rather than to the foregoing specification as indicating the scope of the invention.

I claim:

1. A toy, comprising:

a plurality of three dimensional shapes, each of said plurality of shapes being provided with a motion sensor for detecting movement of said shape, and in response to detecting movement activating a light display and a sound program, said light display generating a light activation or a series of light activations in a sequence correlated to the specific shape and said sound program generating a sound or sounds correlated with the specific shape;

a base having a plurality of receptacles for receiving said plurality of shapes, each of said receptacles being formed to receive only one of said plurality of shapes and each of said receptacles being provided with a shape sensor for generating a predetermined signal in response to sensing when a corresponding shape has been inserted in said receptacle; and a control means in said base for receiving the shape sensing signal from each of said plurality of receptacles in said base and activating playing of a predetermined musical rendition correlated to which shape was first inserted in a receptacle in said base when said control means determines that a correctly correlated shape has been placed into each receptacle of said base.

2. A toy in accordance with claim 1 wherein said base is provided with a circular housing with a central portion and a peripheral portion, said central portion being provided with a light which is energized when said control means determines that all receptacles formed in said peripheral portion have received a corresponding shape.

3. A toy in accordance with claim 2 wherein said receptacles formed in said periphery of said circular housing are associated with a color which is coordinated to a specific shape.

4. A toy in accordance with claim 2 wherein said light in said central portion of said base is energized and deenergized in a predetermined sequence determined by which shape is detected to have been first placed in a corresponding receptacle by said control means.

5. A toy in accordance with claim 1 wherein one of said plurality of shapes is a tetrahedron.

6. A toy in accordance with claim 1 wherein one of said plurality of shapes is a cube.

7. A toy in accordance with claim 1 wherein one of said plurality of shapes is an octahedron.

8. A toy in accordance with claim 1 wherein one of said plurality of shapes is a dodecahedron.

9. A toy in accordance with claim 1 wherein one of said plurality of shapes is an icosahedrons.

10. A toy in accordance with claim 1 wherein one of said plurality of shapes is a sphere.

11. A toy in accordance with claim 1 wherein each shape includes a battery.

12. A toy in accordance with claim 1 wherein each shape is made of a translucent material.

13. A toy in accordance with claim 1 wherein said plurality of shapes is six shapes and said plurality of receptacles is six receptacles.

* * * * *